US005459120A

United States Patent [19]

Defieuw et al.

[11] Patent Number: 5,459,120

[45] Date of Patent: Oct. 17, 1995

[54] HEAT-RESISTANT LAYER FOR DYE-DONOR ELEMENT

[75] Inventors: Geert H. Defieuw, Kessel-Lo; Emiel A. Verdonck, Berlaar; Paul Leblans, Kontich, all of Belgium; Johannes Eickmans, Haan, Germany

[73] Assignee: AGFA-Gevaert, N.V., Mortsel, Belgium

[21] Appl. No.: 240,630

[22] Filed: May 11, 1994

[30] Foreign Application Priority Data

Jun. 9, 1993 [EP] European Pat. Off. ..... 93201642

[51] Int. Cl.[6] ..... B41M 5/035; B41M 5/38

[52] U.S. Cl. ..... 503/227; 428/195; 428/206; 428/323; 428/328; 428/330; 428/331; 428/341; 428/412; 428/447; 428/913; 428/914

[58] Field of Search ..... 8/471; 428/195, 428/206, 207, 488.4, 913, 914, 331, 323, 328, 330, 340, 341, 412, 447; 503/227

[56] References Cited

FOREIGN PATENT DOCUMENTS 0407220 1/1991 European Pat. Off. ..... 503/227

*Primary Examiner*—B. Hamilton Hess
*Attorney, Agent, or Firm*—Breiner & Breiner

[57] ABSTRACT

Dye-donor element for use according to thermal dye transfer methods comprising a support having on one side a dye layer and on the other side a heat-resistant layer comprising a binder and inorganic particles having a volume average particle size of at least 1 μm, said heat-resistant layer optionally carrying a topcoat comprising a lubricant, wherein said inorganic particles substantially consist of a mixture of a first type of inorganic particles, which are silicate particles having a Mohs hardness below 2.7, and of a second type of inorganic particles, which are silicate or carbonate particles having a Mohs hardness of at least 2.7 in a ratio by weight of said first type to said second type of inorganic particles comprised between 20:1 and 1:2.

12 Claims, No Drawings

HEAT-RESISTANT LAYER FOR DYE-DONOR ELEMENT

FIELD OF THE INVENTION

The present invention relates to dye-donor elements for use according to thermal dye sublimation transfer and in particular to a heat-resistant layer of said dye-donor elements.

BACKGROUND OF THE INVENTION

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, is heated by means of a thermal printing head provided with a plurality of juxtaposed heat-generating elements or resistors, so that dye is transferred from the selectively heated regions of the dye-donor element to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which has been covered with a dye layer comprising the printing dyes. Usually, an adhesive or subbing layer is provided between the support and the dye layer.

Owing to the fact that the thin support softens when heated during the printing operation and then sticks to the thermal printing head, thereby causing malfunction of the printing apparatus and reduction in image quality, the back of the support (the side opposite to that carrying the dye layer) is typically provided with a heat-resistant layer to facilitate passage of the dye-donor element past the thermal printing head. An adhesive layer may be provided between the support and the heat-resistant layer.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 02/128,899 or a polymeric thermoplast as described in e.g. EP 267,469, JP 58/187,396, JP 63/191,678, JP 63/191,679, JP 01/234,292, and JP 02/70,485).

When multiple prints have to be made using high printing energies in the absence of any cleaning procedures of the thermal printing head, a residue resulting from the binder may form on the heat-generating elements of said thermal printing head and, as a consequence, cause malfunction of the printing device and defects such as jamming, scratching of the printed image, and breakdown of the heat-generating elements. This phenomenon occurs in particular when the average printing power of said heat-generating elements exceeds 4.5 W/mm$^2$. The average printing power is calculated as the total amount of energy applied during one line time divided by the line time and by the surface area of the heat-generating elements. Conventional thermal printers usually operate with a maximum average printing power of 3 to 4.5 W/mm$^2$. However, if higher print densities and/or faster printing speeds are wanted, the average printing power has to be higher than 4.5 W/mm$^2$.

These high printing energies are used in thermal sublimation printers, which for the sublimation (or diffusion) of dye require substantially higher printing energies than thermal wax printers, in which delamination and fusion of the dye layer are caused.

In case silicone-based lubricants are applied in the form of a separate topcoat on the heat-resistant layer for improving the slidability of the dye-donor element past the thermal printing head, a higher amount of deposited residue is formed unfortunately on said thermal printing head.

It has been suggested in e.g. EP 153,880, EP 194,106, EP 279,467, EP 329,117, EP 407,220, and EP 458,538 to incorporate into the heat-resistant layer particles that have a cleaning effect on the thermal printing head during the printing operation. However, soft particles such as organic polymeric beads like e.g. Teflon have no head-cleaning effect during the printing operation. Silicate particles having a Mohs hardness below 2.7 remove dust and loose debris from the surface during the printing operation, but they have no cleaning effect upon thermally degraded polymer, which actually is left on the thermal printing head. This phenomenon is observed especially at high printing energies. Silicate particles having a Mols hardness of at least 2.7 remove dust, loose debris, and thermally degraded polymer, but they have a negative effect on the lifetime of the thermal printing head since they abrade the passivation layer of said head, especially when they are used at high concentration in the heat-resistant layer.

SUMMARY OF THE INVENTION

It is therefore an object of the present invention to provide a dye-donor element for use according to thermal dye transfer methods, said element having favourable slipping properties and nevertheless causing no substantial contamination of the thermal printing head.

It is also an object of the present invention to provide a heat-resistant layer that minimizes the mechanical wear of the passivation layer of the thermal printing head so that the lifetime of the thermal printing head is enhanced.

Further objects will become apparent from the description hereinafter.

According to the present invention a dye-donor element for use according to thermal dye transfer methods is provided, said element comprising a support having on one side a dye layer and on the other side a heat-resistant layer comprising a binder and inorganic particles having a volume average particle size of at least 1 μm, said heat-resistant layer optionally carrying a topcoat comprising a lubricant, wherein said inorganic particles substantially consist of a mixture of a first type of inorganic particles, which are silicate particles having a Mohs hardness below 2.7, and of a second type of inorganic particles, which are silicate or carbonate particles having a Mohs hardness of at least 2.7 in a ratio by weight of said first type to said second type of inorganic particles comprised between 20:1 and 1:2.

The present invention further provides a method of forming an image by:

image-wise heating a dye-donor element comprising a support having on one side a dye layer and on the other side a heat-resistant layer comprising a binder and inorganic particles having a volume average particle size of at least 1 μm and substantially consisting of a mixture of a first type of inorganic particles, which are silicate particles having a Mohs hardness below 2.7, and of a second type of inorganic particles, which are silicate or carbonate particles having a Mohs hardness of at least 2.7 in a ratio by weight of said first type to said second type of inorganic particles comprised between 20:1 and 1:2, and causing transfer of the image-wise heated dye to a receiver sheet.

DETAILED DESCRIPTION OF THE INVENTION

The inorganic particles of the first type for use in the heat-resistant layer according to the present invention, which have a Mohs hardness below 2.7, are salts derived from silica or from silicic acids.

Preferred representatives of inorganic particles of the first type are i.a. clay, China clay, talc, mica, and chlorite.

Especially preferred inorganic particles of the first type are talc, chlorite, and mixtures of both.

Representatives of inorganic particles of the first type are i.a.:

Silicate Typ1.01: Micro Ace Type P3 having a volume average particle size of 4.5 μm and a Mohs hardness of 1 (commercially available from Nippon Talc, Interorgana Chemiehandel)

Silicate Typ1.02: Mistron Ultramix having a volume average particle size of 3.88 μm and a Mohs hardness of 1 (commercially available from Cyprus Minerals)

Silicate Typ1.03: Micro-talc I.T. Extra having a volume average particle size of 4.33 μm and a Mohs hardness of 1 (commercially available from Norwegian Talc Minerals)

Silicate Typ1.04: Cyprubond (surface-treated to improve adhesion to the binder) having a volume particle size of 5.28 μm and a Mohs hardness of 1 (commercially available from Cyprus Minerals).

Silicate Typ1.05: MP10-52 having a volume particle size of 3.15 μm and a Mohs hardness of 1 (commercially available from Pfizer Minerals)

Silicate Typ1.06: MP12-50 having a volume particle size of 2.60 μm and a Mohs hardness of 1 (commercially available from Pfizer Minerals)

Silicate Typ1.07: Stellar 600 having a volume average particle size of 5.16 μm and a Mohs hardness of 1 (commercially available from Cyprus Minerals)

Silicate Typ1.08: Micro Ace Type K1 having a volume average particle size of 4.75 μm and a Mols hardness of 1 (commercially available from Nippon Talc, Interorgana Chemiehandel)

Silicate Typ1.09: Cyprusperse (chlorite), which is a magnesium aluminium silicate having a volume average particle size of 5.57 μm and a Mohs hardness of 2 (commercially available from Cyprus Minerals)

Silicate Typ1.10: Iriodin 111, which consists of mica particles having a volume average particle size of 4.42 μm and a Mohs hardness of 2.5 (commercially available from Merck)

Silicate Typ1.11: Westmin 8-E, which consists of talc particles having a volume average particle size of 4.41 μm and a Mohs hardness of 1 (commercially available from Westmin Talc)

Silicate Typ1.12: Pangel S9, which is an aluminium magnesium silicate having a volume average particle size of 4.84 μm and a Mols hardness of 2–2.5 (commercially available from Keyser & MacKay)

Silicate Typ1.13: Microline a3, which is a talc having a volume average particle size of 2.35 μm and a Mohs hardness of 1 (commercially available from Talc de Luzenac)

Silicate Typ1.14: Microline a5, which is a talc having a volume average particle size of 2.95 μm and a Mohs hardness of 1 (commercially available from Talc de Luzenac)

Silicate Typ1.15: Microline a7, which is a talc having a volume average particle size of 4.09 μm and a Mohs hardness of 1 (commercially available from Talc de Luzenac)

Silicate Typ1.16: Steamic 005, which is a mixture of talc and chlorite (24% by weight) having a volume average particle size of 2.77 μm and a Mohs hardness of 1–2 (commercially available from Talc de Luzenac)

Silicate Typ1.17: Luzenac 10M005, which is a mixture of talc and chlorite (24% by weight) having a volume average particle size of 4.78 μm and a Mohs hardness of 1–2 (commercially available from Talc de Luzenac)

Silicate Typ1.18: Luzenac 10M2, which is a mixture of talc and chlorite (50% by weight) having a volume average particle size of 5.19 μm and a Mohs hardness of 1–2 (commercially available from Talc de Luzenac)

Suitable inorganic particles of the second type for use in the heat-resistant layer according to the present invention, which have a Mohs hardness of at least 2.7, are i.a. amorphous silica, quartz, calcium carbonate, calcium magnesium carbonate (dolomite), and magnesium carbonate. Among these amorphous silica particles and calcium magnesium carbonate particles are especially preferred.

Representatives of the second type of inorganic particles, which have a Mohs hardness of at least 2.7, are i.a.:

Silicate Typ2.01: Syloid 244, which is an amorphous silica having a volume average particle size of 1.96 μm and a Mohs hardness of about 4 (commercially available from Grace Davidson)

Silicate Typ2.02: Syloid 266, which is an amorphous silica having a volume average particle size of 2.11 μm and a Mohs hardness of about 4 (commercially available from Grace Davidson)

Silicate Typ2.03: Syloid 378, which is an amorphous silica having a volume average particle size of 3.45 μm and a Mohs hardness of about 4 (commercially available from Grace Davidson)

Silicate Typ2.04: amorphous monodisperse silica particles prepared by heating Tospearl 120 (polymethylsilylsesquioxan) for 4 h at 700° C. and having a volume average particle size of 1.87 μm and a Mohs hardness of about 4 (Tospearl 120 is available from Toshiba Silicones)

Silicate Typ2.05: amorphous monodisperse silica particles prepared by heating Tospearl 130 (polymethylsilylsesquioxan) for 4 h at 700° C. and having a volume average particle size of 2.57 μm and a Mohs hardness of about 4 (Tospearl 130 is available from Toshiba Silicones)

Silicate Typ2.06: amorphous monodisperse silica particles prepared by heating Tospearl 145 (polymethylsilylsesquioxan) for 4 h at 700° C. and having a volume average particle size of 3.57 μm and a Mohs hardness of about 4 (Tospearl 145 is available from Toshiba Silicones)

Silicate Typ2.07: Min-u-sil 5, which is a crystalline silica (quartz) having a volume average particle size of approximately 5 μm and a Mols hardness of 7 (commercially available from Pennsylvania Glass Sand Corporation)

Silicate Typ2.08: Sikron C800, which is a crystalline silica (quartz) having a volume average particle size of approximately 5 μm and a Mohs hardness of 7 (commercially available from Sifraco, Compiegne)

Dolomite Typ2.09: Microdol Super, which is a calcium magnesium carbonate having a volume average particle size of 3.05 μm and a Mohs hardness of 3.5 (commercially available from Norwegian Talc)

Dolomite Typ2.10: Microdol Extra, which is a calcium magnesium carbonate having a volume average particle size of 4.08 μm and a Mols hardness of 3.5 (commercially available from Norwegian Talc)

Dolomite Typ2.11: Myanit 0-10, which is a calcium magnesium carbonate having a volume average particle size of approximately 4 μm and a Mohs hardness of 3.5 (commercially available from Norwegian Talc)

The mixture of said first type of inorganic particles having a Mohs hardness below 2.7 and of said second type of inorganic particles having a Mohs hardness of at least 2.7 is prepared by simply adding both types of particles to one another and stirring or agitating them. The resulting mixture can then be added as such to the coating composition for the heat-resistant layer. It is also possible to add both types of particles separately to the coating composition for the heat-resistant layer.

Mixtures of said first type of inorganic particles having a Mohs hardness below 2.7 and of said second type of inorganic particles having a Mohs hardness of at least 2.7 are also commercially available.

A commercially available mixture is e.g.:

Blend 1: Micro-talc AT Extra, which is a mixture of talc and magnesium carbonate having a volume average particle size of 4.32 μm and a Mohs hardness of 4.32 (commercially available from Norwegian Talc Minerals)

The particle size of the inorganic particles for use in the heat-resistant layer according to the present invention is a volume average particle size as measured by means of a Coulter Multisizer II having an aperture of 30 μm. A particle having a size of 5 μm (Dynosphere SS-051-P) is used to calibrate the apparatus. The calibration constant is 349.09. The inorganic particles are dispersed in an aqueous 0.1N sodium chloride solution comprising a fluorine surfactant before the measurement of the particle size and of the particle size distribution. The measurement is performed for particle sizes ranging from 0.7 to 22.4 μm. The selected siphon mode is 500 μl.

The volume average particle size of said inorganic particles having a Mohs hardness below 2.7 preferably ranges from 3 to 7 μm, whereas that of said inorganic particles having a Mols hardness of at least 2.7 preferably ranges from 1 to 4.5 μm.

At least one kind of inorganic particles having a Mohs hardness below 2.7 can be mixed with at least one kind of inorganic particles having a Mohs hardness of at least 2.7 for use in the heat-resistant layer according to the present invention. Although the ratio by weight of inorganic particles of said first type to inorganic particles of said second type is normally comprised between 20:1 and 1:2, it is usually preferable that the weight of inorganic particles of said first type exceeds the weight of inorganic particles of said second type, since the inorganic particles of the first type do not at all abrade the passivation layer of the thermal printing head. A preferred ratio by weight of first type to second type particles is therefore comprised between 10:1 and 3:1.

The total amount of inorganic particles in the heat-resistant layer is generally not higher than 1 g/m2 and smaller amounts usually suffice to clean the thermal printing head during the printing operation. Preferably, 5 to 100 mg/m2 of inorganic particles having a Mohs hardness below 2.7 and 2 to 30 mg/m2 of inorganic particles having a Mohs hardness of at least 2.7 are used in the heat-resistant layer.

Colloidal silica such as Aerosil R972 (Degussa) can further be added to the heat-resistant layer according to the present invention. Although mixtures of silicate particles having a Mohs hardness below 2.7 with colloidal silica having a particle size below 1 μm are generally useful in a heat-resistant layer, it is epecially preferred to add colloidal silica to the heat-resistant layer according to the present invention.

The binder for the heat-resistant layer can be a cured binder or a polymeric thermoplast.

A cured binder can be produced by a chemical reaction as described in e.g. EP 153,880 and EP 194,106, or by the influence of moisture as described in e.g. EP 528,074, or by irradiation of a radiation-curable composition as described in e.g. EP 314,348 and EP 458,538.

Thanks to the fact that the coating procedure of polymeric thermoplasts is very convenient, they are preferably used as binder for the heat-resistant layer. Preferred polymeric thermoplasts are those having a glass transition temperature above 100° C.; these thermoplasts are suited for use as binder in the heat-resistant layer, because they are dimensionally stable at higher temperatures. Polymers having a glass transition temperature above 170° C. are especially preferred. Even more preferred polymeric thermoplasts are those that are soluble in ecologically acceptable solvents such as ketones (e.g. ethyl methyl ketone and acetone) and alcohols (e.g. isopropanol).

Representatives of polymeric thermoplasts that are suited for use as binder in the heat-resistant layer are e.g. poly-(styrene-co-acrylonitrile), polycarbonates derived from bisphenol A, polyvinyl butyral, polyvinyl acetal, ethyl cellulose, cellulose acetate butyrate, cellulose acetate propionate, and polyparabanic acid.

Especially preferred polymeric thermoplasts are the polycarbonates derived from a bis-(hydroxyphenyl)-cycloalkane corresponding to general formula (I):

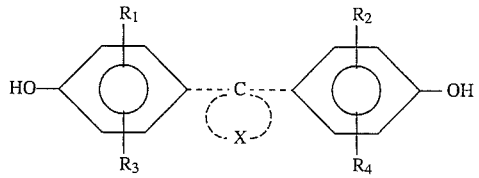

(I)

wherein:

$R^1$, $R^2$, $R^3$, and $R^4$ (same or different) represent hydrogen, $R^1$, $R^2$, $R^3$, and $R^4$ (same or different) represent hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which optionally carries at least one $C_1$–$C_6$ alkyl group or at least one 5- or 6-membered cycloalkyl group, or carries a fused-on 5- or 6-membered cycloalkyl group.

These polycarbonates provide a better heat-stability to the heat-resistant layer than conventional polymeric thermoplasts. They also have higher glass transition temperatures (Tg), typically in the range of about 180° C. to about 260° C., than polycarbonates derived from bisphenol A (Tg of about 150° C.). The polycarbonates can be homopolycarbonates as well as copolycarbonates.

Preferably one to two carbon atoms of the group of atoms represented by X, more preferably only one carbon atom of that group, carry (carries) two $C_1$–$C_6$ alkyl groups on the same carbon atom. A preferred alkyl group is methyl. Preferably, the carbon atoms of the group of atoms represented by X, which stand in α-position to the diphenyl-substituted carbon atom, do not carry two $C_1$–$C_6$ alkyl groups. Substitution with two $C_1$–$C_6$ alkyl groups is preferred on the carbon atom(s) in β-position to the diphenyl-substituted carbon atom is preferred.

Preferred examples of bis-(hydroxyphenyl)-cycloalkanes corresponding to general formula I, which can be employed for preparing the polycarbonates that can be used according to the present invention are those comprising 5- or 6-membered alicyclic rings. Examples of such bis-(hydroxyphenyl)-cycloalkanes are those corresponding to the following structural formulae II to IV.

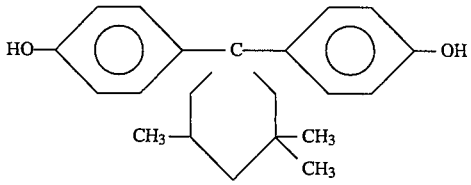

(II)

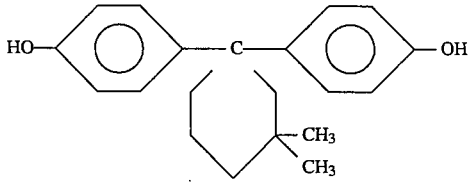

(III)

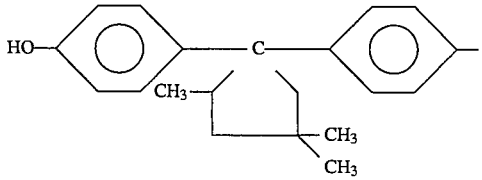

(IV)

A particularly preferred bis-(hydroxyphenyl)-cycloalkane is 1,1-bis-(4-hydroxyphenyl)-3,3,5-trimethylcyclohexane (formula (II)).

The synthesis of suitable bis-(hydroxyphenyl)-cycloalkanes corresponding to general formula (I) has been described in e.g. DE 3 832 396. The bis-(hydroxyphenyl)-cycloalkanes are used to prepare high molecular weight thermoplastic aromatic polycarbonates for use according to the present invention.

Homopolycarbonates can be prepared from bis-(hydroxyphenyl)-cycloalkanes corresponding to general formula (I), but also copolycarbonates can be prepared by simultaneously using different bis-(hydroxyphenyl)-cycloalkanes, each of which individually corresponds to the general formula (I).

In the preparation of high molecular weight, thermoplastic, aromatic polycarbonates for use according to the present invention the bis-(hydroxyphenyl)-cycloalkanes corresponding to general formula (I) can also be used in combination with other hydroxyphenyl compounds that do not correspond to general formula (I), e.g. with compounds that correspond to the general formula:

$$HO—Z—OH \qquad (VII)$$

Useful compounds corresponding to general formula (VII) are diphenols, in which Z stands for a bivalent aromatic ring system having from 6 to 30 carbon atoms, which ring system contains at least one aromatic nucleus. The aromatic group Z may carry substituents and may contain aliphatic or alicyclic residues such as the alicyclic residues contained in the bis-(hydroxyphenyl)-cycloalkanes corresponding to general formula (I) or may contain heteroatoms as bond between the separate aromatic nuclei.

Examples of compounds corresponding to general formula (VII) are i.a. hydroquinone, resorcinol, dihydroxydiphenyl, bis-(hydroxyphenyl)-alkanes, bis-(hydroxyphenyl)-cycloalkanes, bis-(hydroxyphenyl)-sulfide, bis-(hydroxyphenyl)-ether, bis-(hydroxyphenyl)-ketone, bis-(hydroxyphenyl)-sulfone, bis-(hydroxyphenyl)-sulfoxide, α,α'-bis-(hydroxyphenyl)-diisopropylbenzene, and such compounds carrying at least one alkyl and/or halogen substituent on the aromatic nucleus.

These and other suitable compounds corresponding to general formula (VII) have been described in e.g. U.S. Pat. No. 3,028,365, U.S. Pat. No. 2,999,835, U.S. Pat. No. 3,148,172, U.S. Pat. No. 3,275,601, U.S. Pat. No. 2,991,273, U.S. Pat. No. 3,271,367, U.S. Pat. No. 3,062,781, U.S. Pat. No. 2,970,131, U.S. Pat. No. 2,999,846, DE 1,570,703, DE 2,063,050, DE 2,063,052, DE 2,211,956, FR 1,561,518, and in "Chemistry and Physics of Polycarbonates", Interscience Publishers, New York, 1964.

Other preferred compounds corresponding to general formula (VII) are i.a. 4,4'-dihydroxydiphenyl, 2,2-bis-(4-hydroxyphenyl) -propane, 2,4-bis-(4-hydroxyphenyl)-2-methylbutane, 1,1-bis-(4-hydroxyphenyl)-cyclohexane, α,α'-bis-(4-hydroxyphenyl)-p-diisopropyl-benzene, 2,2-bis-(3-methyl-4-hydroxyphenyl)-propane, 2,2-bis-(3-chloro-4-hydroxyphenyl)-propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxyphenyl)-2-methylbutane, 1,1-bis-(3,5-dimethyl-4-hydroxyphenyl)-cyclohexane, α,α'-bis-(3,5-dimethyl-4-hydroxyphenyl)-p-diisopropylbenzene, 2,2-bis-(3,5-dichloro-4-hydroxyphenyl)-propane, and 2,2-bis-(3,5-dibromo-4-hydroxyphenyl)-propane.

Especially preferred compounds corresponding to general formula (VII) are i.a. 2,2-bis-(4-hydroxyphenyl)-propane, 2,2-bis-(3,5-dimethyl-4-hydroxyphenyl)-propane, 2,2-bis-(3,5-dichloro-4-hydroxyphenyl)-propane, 2,2-bis-(3,5-dibromo-4-hydroxyphenyl)-propane, and 1,1-bis-(4-hydroxyphenyl)-cyclohexane.

Especially preferred is 2,2-bis-(4-hydroxyphenyl)-propane (bisphenol A).

Incorporation of bisphenol A in the polycarbonate for use according to the present invention reduces the brittleness of the polycarbonate. This results in less scratches caused by the contaminated thermal printing head in the transferred image. However, by incorporation of bisphenol A the glass transition temperature is decreased as compared with that of the homopolycarbonate. A compromise has thus to be found between scratching and heat-stability.

At least one compound corresponding to general formula (VII) can be used in combination with bis-(hydroxyphenyl)-cycloalkanes corresponding to general formula (I).

If in the preparation of polycarbonates according to the present invention the bis-(hydroxyphenyl)-cycloalkanes corresponding to general formula (I) are used together with at least one compound corresponding to general formula (VII), the amount of bis-(hydroxyphenyl)-cycloalkanes corresponding to general formula (I) in the mixture is at least 10 mol %, preferably at least 25 mol %.

According to another preferred embodiment the polycarbonate for use according to the present invention is derived from 100 mol % of bis-(hydroxyphenyl)-cycloalkanes corresponding to the above general formula (I).

The high molecular weight polycarbonates can be prepared according to preparation methods for polycarbonates known in the art. The bis-(hydroxyphenyl)-cycloalkane units and the units resulting from the compounds corresponding to general formula (VII) can be present in the polycarbonate in different blocks or the different units can be distributed randomly.

The isolation of the polycarbonates is performed as known in the art.

The polycarbonates can also be prepared in homogeneous phase according to a known method (the so-called pyridine method) or according to the known melt ester-interchange process by using e.g. diphenyl carbonate instead of phosgene. In this case as well, the polycarbonates are isolated according to methods known in the art.

Preferably, the molecular weight of the polycarbonates is at least 8000, preferably from 8000 to 200,000 and more preferably from 10,000 to 80,000.

Polycarbonates derived from bis-(hydroxyphenyl)-cycloalkanes corresponding to formula (I) are used as binder in the heat-resistant layer of the dye-donor element according to the present invention in an amount of at least 10% by weight, preferably in an amount from 30 to 100% by weight. A mixture of two or more of said polycarbonates can also be used in the heat-resistant layer.

Examples of polycarbonates that can be used advantageously in accordance with the present invention are i.a.:

PC1 Homopolycarbonate having the following structure:

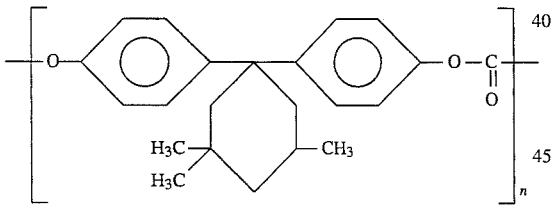

wherein n has a value giving a relative viscosity of 1.295 (measured in a 0.5% by weight solution in dichloromethane)

PC2 Homopolycarbonate having the same structure as PC1 but having a relative viscosity of 2.2

PC3 Copolycarbonate having the following structure:

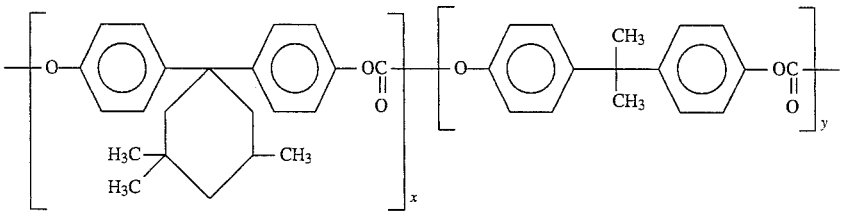

wherein x=55 mol % and y=45 mol %; PC3 has a relative viscosity of 1.295.

The binder of the heat-resistant layer of the dye-donor element according to the present invention may also consist of at least two different mixed binders.

The heat-resistant layer of the dye-donor element according to the present invention may in addition to said inorganic particles and the binder comprise minor amounts of such other agents like surface-active agents, liquid lubricants, solid lubricants such as waxes e.g. polyethylene wax, polypropylene wax, and amide wax, or mixtures thereof.

The heat-resistant layer according to the present invention may contain other additives provided such materials do not inhibit the anti-sticking properties of the heat-resistant layer and provided that such materials do not scratch, erode, contaminate, or otherwise damage the thermal printing head or harm image quality. Examples of suitable additives have been described in EP 389,153.

Suitable surface-active agents for the heat-resistant layer of the dye-donor element according to the present invention are i.a.: alkyl phenyl polyalkylene oxides e.g. Antarox CO 630 (GAF), alkyl polyalkylene oxides e.g. Renex 709 (ICI), and sorbitol esters e.g. Span 85 (ICI) and Tween 20 (ICI).

Preferred lubricants for use in the heat-resistant layer of the dye-donor element according to the present invention are polysiloxan-based lubricants. Among these polyalkylene oxide-modified polydimethylsiloxans such as Byk 320, Byk 307, and Byk 330 (Byk Cera) and Tegoglide 410 (Goldschmidt) are especially preferred. Mixtures of alkyl-, aryl-, or alkylaryl-modified polyethylene oxide surface-active agents with polyalkylene oxide-modified polydimethylsiloxans are also especially preferred because they yield prints having a highly uniform density. Examples of such mixtures are i.a. Byk 320 with Antarox CO 630 , Byk 320 with Antarox CO 850, and Tegoglide 410 with Antarox CO 630.

The heat-resistant layer of the dye-donor element according to the present invention is formed preferably by adding the polymeric thermoplastic binder or binder mixture, the inorganic particles, and other optional components to a suitable solvent or solvent mixture, dissolving or dispersing the ingredients to form a coating composition, applying said coating composition to a support, which may have been provided first with an adhesive or subbing layer, and drying the resulting layer.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

Although the above-mentioned ingredients of the heat-resistant layer can be incorporated in one single layer, it is sometimes preferred to incorporate at least part of the additives such as lubricants and/or surface-active agents in a separate topcoat on top of the heat-resistant layer. As a result the lubricants and/or surface-active agents are in direct contact with the thermal printing head and thus lead to improved slipping properties of the the dye-donor element.

A preferred combination of a heat-resistant layer and a topcoat is a heat-resistant layer comprising said inorganic particles and optionally a surface-active agent and a topcoat comprising a polydimethylsiloxan-based lubricant and optionally an alkyl-, aryl-, or alkylaryl-modified polyethylene oxide surface-active agent.

In case the heat-resistant layer is covered with a topcoat, the inorganic particles incorporated into said heat-resistant layer and/or into a said underlying subbing layer should protrude from the surface of said topcoat.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, EP 564,010, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057, U.S. Pat. No. 4,737,486, U.S. Pat. No. 4,965,239, U.S. Pat. No. 4,753,921, U.S. Pat No. 4,895,830, U.S. Pat. No. 4,929,592, U.S. Pat. No. 4,748,150, U.S. Pat. No. 4,965,238, and U.S. Pat. No. 4,965,241. Preferably the subbing layer further comprises an aromatic polyol such as e.g. 1,2-dihydroxybenzene as described in EP 433,496.

Instead of incorporating the inorganic particles for use in accordance with the present invention in the heat-resistant layer, they can be incorporated at least partially into a said subbing layer between the support and said heat-resistant layer.

Any dye can be used in the dye layer of the dye-donor element of the present invention provided it is transferable to the receiver sheet by the action of heat. Examples of suitable dyes have been described in e.g. EP 432,829, EP 400,706, EP 485,665, EP 498,083, EP 453,020, and in the references mentioned therein.

The amount ratio of dye or dye mixture to binder generally ranges from 9:1 and 1:3 by weight, preferably from 3:1 and 1:2 by weight.

The following polymers can be used as polymeric binder: cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copoly(styrene/acrylonitrile); polysulfones; polyphenylene oxide; organosilicones, such as polysiloxans; epoxy resins and natural resins, such as gum arabic. Preferably, the binder for the dye layer of the present invention comprises copoly(styrene/acrylonitrile).

The dye layer may also contain other additives such as i.a. thermal solvents, stabilizers, curing agents, preservatives, organic or inorganic fine particles, dispersing agents, antistatic agents, defoaming agents, and viscosity-controlling agents, these and other ingredients being described more fully in EP 133,011, EP 133,012, EP 111,004, and EP 279,467.

Addition of beads of polyolefin waxes or amid waxes, and/or of polymethylsilylsesquioxan particles, as described in EP 554,583, to the dye layer, said beads and/or particles protruding from the surface of said layer, is especially preferred.

Any material can be used as the support for the dye-donor element provided it is dimensionally stable and capable of withstanding the temperatures involved up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive of subbing layer, if desired. Examples of suitable subbing layers have been described in e.g. EP 433,496, EP 311,841, EP 268,179, U.S. Pat. No. 4,727,057, and U.S. Pat. No. 4,695,288.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropylacrylamide, butyl methacrylate-grafted gelatin, ethyl methacrylate-grafted gelatin, ethyl acrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye layer so that the need for a separate adhesive or subbing layer is avoided. These particular hydrophilic polymers used in a single layer in the dye-donor element thus perform a dual function, hence are referred to as dye-barrier/subbing layers.

The support for the receiver sheet that is used with the dye-donor element may be a transparent film of e.g. polyethylene terephthalate, a polyether sulfone, a polyimide, a cellulose ester, or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polyvinyl chloride, polystyrene-co-arcylonitrile, polycaprolactone, or mixtures thereof. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, EP 227,094, and EP 228,066.

In order to improve the light resistance and other stabilities of recorded images, UV absorbers, singlet oxygen quenchers such as HALS-compounds (Hindered Amine Light Stabilizers) and/or antioxidants may be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be applied in a separate layer on at least part of the dye layer or of the dye-image-receiving layer. Suitable releasing agents are solid waxes, fluorine- or phosphate-containing surfactants and silicone oils. Suitable releasing agents have been described in e.g. EP 133,012, JP 85/19,138, and EP 227,092.

The dye-donor elements according to the invention are used to form a dye transfer image, which process comprises placing the dye layer of the dye-donor element in face-to-face relation with the dye-image-receiving layer of the receiver sheet and image-wise heating from the back of the dye-donor element. The transfer of the dye is accomplished by heating for about several milliseconds at a temperature of 400° C.

Preferably, the average printing power applied by means of a thermal printing head during the image-wise heating of the dye-donor element is higher than 4.5 W/mm$^2$.

When the image-wise heating process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

The following example illustrates the invention in more detail without, however, limiting the scope thereof.

EXAMPLE

A series of dye-donor elements for use according to thermal dye sublimation transfer were prepared as follows.

Polyethylene terephthalate film having a thickness of 6 μm was provided on both sides with a subbing layer from a solution of copolyester comprising isophthalic acid units/terephthalic acid units/ethylene glycol units/neopentyl glycol units/adipic acid units/glycerol units in ethyl methyl ketone.

A solution comprising 8% by weight of dye A, 4% by weight of dye B, and 10% by weight of poly(styrene-co-acrylonitrile) as binder in ethyl methyl ketone as solvent was prepared:

Dye A

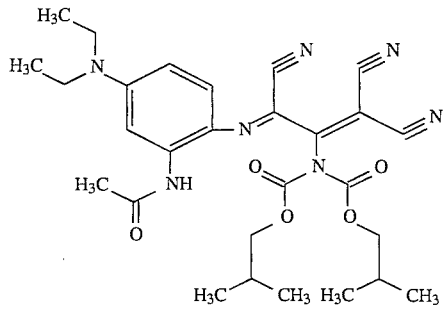

Dye B

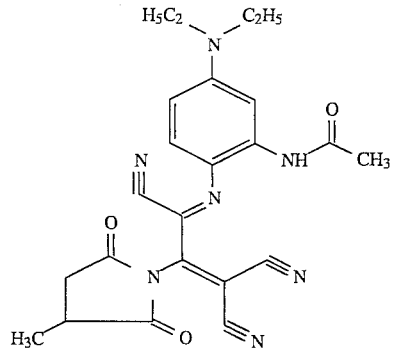

From the resulting solution a layer having a wet thickness of 10 μm was coated on the subbed polyethylene terephthalate film. The resulting dye layer was dried by evaporation of the solvent.

A heat-resistant layer having a wet thickness of 10 μm was coated on the subbed back of the polyethylene terephthalate film from a solution in ethyl methyl ketone containing a polycarbonate binder PC1 (13% by weight) and inorganic particles (the nature and amount of which are indicated below in Table 1).

The side of the donor elements that showed the heat-resistant layer was coated with a solution forming a topcoat, said solution being a 0.5 % by weight solution of Tegoglide 410 (commercially available from Goldschmidt) in isopropanol.

Receiver sheets were prepared by coating a polyethylene terephthalate film support having a thickness of 175 μm with a dye-image-receiving layer from a solution in ethyl methyl ketone of 3,6 g/m$^2$ of poly(vinyl chloride/co-vinyl acetate/co-vinyl alcohol) (Vinylite VAGD supplied by Union Carbide), 0,336 g/m$^2$ of diisocyanate (Desmodur VL supplied by Bayer AG), and 0,2 gm$^2$ of hydroxy-modified polydimethylsiloxan (Tegomer H SI 2111 supplied by Goldschmidt).

Each dye-donor element was printed in combination with a receiver sheet in a printer set-up using a Kyocera thermal printing head, Type KGT-219-12MP4-75PM at an average power of 60 mW per dot (total amount of energy applied to one resistor element divided by the total line time, 80 mW with a duty cycle of 75%). The surface of the heater element measured 68 by 152 mm. Consequently, the average printing power applied to the heater elements was 5.8 W/mm2. The printing was repeated 100 times for each dye-donor element. All heat-resistant layers as identified in Table 1 hereinafter allowed easy continuous transport across the thermal printing head.

Next, the thermal printing head was disconnected from the printer and inspected under an optical microscope (Leitz microscope: enlargement 100×) to trace any contamination of the resistors of the thermal printing head. The following levels of contamination were attributable: excellent (no contamination at all), good (hardly perceptible contamination), moderate (clearly visible contamination), and bad (extensive contamination all over the electrode surfaces).

In Table 1 hereinafter (E) stands for excellent, (G) for good, (M) for moderate, and (B) for bad. The amounts of the inorganic particles and binder are indicated in % by weight calculated on the total weight of the coating solution (solvent was added up to 100%). The results obtained are listed in Table 1.

TABLE 1

| | Heat-resistant layer composition | | | | Contamination |
|---|---|---|---|---|---|
| | Particles of first type | % (wt) | Particles of second type | % (wt) | (after 100 prints) |
| Comparison | | | | | |
| Comp.1 | — | — | — | — | B* |
| Comp.2 | Typ1.01 | 0.5 | — | — | B |
| Comp.3 | Typ1.01 | 1.5 | — | — | M |
| Comp.4 | Typ1.03 | 0.5 | — | — | B |
| Comp.5 | Typ1.04 | 0.5 | — | — | M |
| Comp.6 | Typ1.08 | 0.5 | — | — | B |
| Comp.7 | Typ1.09 | 0.5 | — | — | M |
| Comp.8 | Typ1.01 | 0.5 | Aerosil R972 | 5 | B |
| Comp.9 | — | — | Typ2.01 | 0.1 | B |
| Comp.10 | — | — | Typ2.01 | 0.25 | M |
| Invention | | | | | |
| Inv.1 | Typ1.01 | 0.5 | Typ2.01 | 0.2 | E |
| Inv.2 | Typ1.01 | 0.5 | Typ2.02 | 0.1 | G |
| Inv.3 | Typ1.01 | 0.5 | Typ2.09 | 0.2 | G |
| Inv.4 | Typ1.01 | 0.5 | Typ2.09 | 0.3 | E |
| Inv.5 | Blend 1 | 0.5 | — | — | G |
| Inv.6 | Blend 1 | 1.0 | — | — | E |

B* means that the thermal printing head was covered entirely with contaminating deposits.

Aerosil R972 is a colloidal silica available from Degussa and having a particle size of 16 nm The above results show that the best results with respect to avoiding contamination of the thermal printing head are obtained by the combined use of inorganic particles having a Mohs hardness below 2.7 and inorganic particles having a Mohs hardness of at least 2.7 in the heat-resistant layer.

It is also clear that the amount of particles having a Mohs hardness of at least 2.7 can be reduced if these particles are combined with inorganic particles having a Mohs hardness below 2.7. This offers the advantage that the mechanical wear of the passivation layer of the thermal printing head is minimized so that the lifetime of the latter is enhanced.

We claim:

1. Dye-donor element for use according to thermal dye transfer methods, said element comprising a support having on one side a dye layer and on the other side a heat-resistant layer comprising a binder and inorganic particles having a volume average particle size of at least 1 μm, wherein said inorganic particles substantially consist of a mixture of a first type of inorganic particles, that are silicate particles having a Mols hardness below 2.7, and of a second type of inorganic particles, that are silicate or carbonate particles having a Mohs hardness of at least 2.7 in a ratio by weight of said first type to said second type of inorganic particles comprised between 20:1 and 1:2.

2. A dye-donor element according to claim 1, wherein the volume average particle size of said silicate particles having a Mohs hardness below 2.7 ranges from 3 to 7 μm and that of said silicate or carbonate particles having a Mohs hardness of at least 2.7 ranges from 1 to 4.5 μm.

3. A dye-donor element according to claim 1 or 2, wherein said particles having a Mohs hardness below 2.7 are clay, China clay, talc, mica, or chlorite particles.

4. A dye-donor element according to claim 1, wherein said particles having a Mohs hardness of at least 2.7 are amorphous silica particles or calcium magnesium carbonate particles.

5. A dye-donor element according to claim 1, wherein 5 to 100 mg/m2 of said particles having a Mohs hardness below 2.7 and 2 to 30 mg/m2 of particles having a Mohs hardness of at least 2.7 are present in said heat-resistant layer.

6. A dye-donor element according to claim 1, wherein said binder is a polymeric thermoplast.

7. A dye-donor element according to claim 6, wherein said binder comprises a polycarbonate derived from a bis-(hydroxyphenyl)-cycloalkane corresponding to general formula (I):

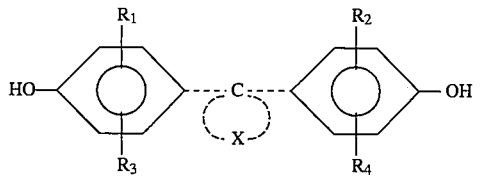

(I)

wherein:

$R^1$, $R^2$, $R^3$, and $R^4$ (same or different) represent hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which optionally carries at least one $C_1$–$C_6$ alkyl group or at least one 5- or 6-membered cycloalkyl group, or carries a fused-on 5- or 6-membered cycloalkyl group.

8. A dye-donor element according to claim 1, wherein said heat-resistant layer carries a topcoat comprising a lubricant.

9. A dye-donor element according to claim 8, wherein said lubricant is a polydimethylsiloxane based lubricant.

10. Method of forming an image by:

image-wise heating a dye-donor element comprising a support having on one side a dye layer and on the other side a heat-resistant layer comprising a binder and inorganic particles having a volume average particle size of at least 1 μm and substantially consisting of a mixture of a first type of inorganic particles, that are silicate particles having a Mohs hardness below 2.7, and of a second type of inorganic particles, that are silicate or carbonate particles having a Mohs hardness of at least 2.7 in a ratio by weight of said first type to said second type of inorganic particles comprised between 20:1 and 1:2, and causing transfer of the image-wise heated dye to a receiver sheet.

11. A method according to claim 10, wherein the average printing power applied by means of a thermal printing head during said image-wise heating is higher than 4.5 W/mm$^2$.

12. A method according to claim 10 or 11, wherein said heat-resistant layer carries a topcoat comprising a lubricant.

* * * * *